US009653049B2

(12) United States Patent
Canivell Grifols

(10) Patent No.: US 9,653,049 B2
(45) Date of Patent: May 16, 2017

(54) DEVICE FOR ALTERING THE TENSION OF THE STRINGS OF A STRINGED MUSICAL INSTRUMENT

(71) Applicant: LLEVINAC, S.L., Barcelona (ES)

(72) Inventor: Jordi Canivell Grifols, Barcelona (ES)

(73) Assignee: LLEVINAC, S.L., Barcelona (ES)

( * ) Notice: Subject to any disclaimer, the term of this patent is extended or adjusted under 35 U.S.C. 154(b) by 0 days.

(21) Appl. No.: 15/117,170

(22) PCT Filed: Jan. 21, 2015

(86) PCT No.: PCT/ES2015/070036

§ 371 (c)(1),
(2) Date: Aug. 5, 2016

(87) PCT Pub. No.: WO2015/118195

PCT Pub. Date: Aug. 13, 2015

(65) Prior Publication Data

US 2016/0351173 A1 Dec. 1, 2016

(30) Foreign Application Priority Data

Feb. 7, 2014 (ES) ..... 201430161

(51) Int. Cl.
*G10D 3/14* (2006.01)
*G10D 1/08* (2006.01)

(52) U.S. Cl.
CPC ..... *G10D 3/146* (2013.01); *G10D 1/085* (2013.01)

(58) Field of Classification Search
CPC G10D 3/146; G10D 3/04; G10D 3/12; G10D 3/14; G10D 3/00; G10D 3/143
USPC ..... 84/313
See application file for complete search history.

(56) References Cited

U.S. PATENT DOCUMENTS 4,782,732 A 11/1988 Kato et al.
4,944,208 A 7/1990 Kusek
5,847,297 A * 12/1998 Fisher, IV ..... G10D 3/146 84/313
6,384,311 B1 5/2002 Cota
2012/0132055 A1 5/2012 Brinkley, Jr. et al.

* cited by examiner

*Primary Examiner* — Kimberly Lockett
(74) *Attorney, Agent, or Firm* — Knobbe Martens Olson & Bear, LLP

(57) ABSTRACT

The invention relates to a device for altering the tension of the strings of a stringed musical instrument, of the type comprising a structural element, with at least one element for securing to the body of the instrument, said structural element comprising at least two runners each secured to at least one string of the instrument, and an actuation mechanism for actuating the runners in order to alter the tension of the strings of the instrument, comprising at least one slide carriage that can be moved by the action of at least one lever.

13 Claims, 24 Drawing Sheets

DEVICE FOR ALTERING THE TENSION OF THE STRINGS OF A STRINGED MUSICAL INSTRUMENT

CROSS-REFERENCE TO RELATED APPLICATIONS

This application is the U.S. National Phase under 35 U.S.C. §371 of International Application PCT/ES2015/070036, filed Jan. 21, 2015, which claims priority to Spanish Patent Application 201430161, filed Feb. 7, 2014, which are hereby incorporated by reference in their entirety.

FIELD OF THE INVENTION

The present invention relates to the field of devices for altering the tension of the strings of stringed musical instruments.

Particularly, the present invention relates to a device for altering the tension of the strings of a guitar during use thereof.

BACKGROUND OF THE INVENTION

Such devices are also known as "tremolo devices", "vibrato devices" or simply "tremolo" or "vibrato", among other terms.

For a better understanding of the invention and to provide greater clarity thereof, the following terms are defined below:

The term "bridge of the guitar" means the part located in the lower part of the top or body of the guitar that holds the strings.

The term "saddle" means a part located on top of the bridge of the guitar, on which the strings sit or are supported and from which the vibration of the strings begins. In addition, the saddle transmits the vibrations of the strings to the bridge and the body. The part known in English as the "saddle" is also known in Spanish as "selleta", "silleta", "sillin" or "asiento".

Tremolo or vibrato devices usually consist of a bridge unit that is movable about an axis and upon which are arranged the saddles corresponding to each string of the guitar, said bridge unit comprising an arm that acts as a lever upon which the guitarist can apply pressure in order to move said bridge unit and thereby alter the tension of the strings. Tremolo devices tend to have one or more springs that act directly on the actuation mechanism via the lever, facilitating the return of the lever to the neutral position.

However, many bridge units in the state of the art are bulky units of considerable weight, and are therefore very troublesome for the guitarist. In addition, many of these units are not suitable for all types of guitar and, in many cases, require at least one perforation to be made in the body of the guitar in order to incorporate the spring mechanism associated with said bridge units. Moreover, many tremolo units fail to maintain a constant equilibrium between the tension exerted by the strings and the opposing tension exerted by the springs, leading to loss of the tuning of the guitar strings.

SUMMARY OF THE INVENTION

It is an aim of the present invention to disclose a tremolo device that solves the problems raised above and that makes it possible to obtain a tremolo device that is more compact and convenient for the user and does not result in loss of the tuning of the guitar strings. More particularly, an aim of the present invention is to disclose a tremolo device that makes it possible to act only on certain strings at the choice of the user.

In particular, the present invention discloses a device for altering the tension of the strings of a stringed musical instrument, of the type that comprises a structural element, with at least one element for securing to the body of the instrument, said structural element comprising at least two runners capable of moving on said structural element, each of said runners being secured to at least one string of the musical instrument, and an actuation mechanism for actuating the runners in order to alter the tension of the strings of the instrument, comprising at least one slide carriage that can be moved in a sliding motion by the action of at least one lever. Said device is characterised in that said actuation mechanism for actuating the runners further comprises a runner selection mechanism that comprises, in turn, a clutch for each of said runners for selective connection between the actuation mechanism and said runners. Thus, the device makes it possible to act only on certain strings selected by the user by means of the corresponding clutch.

Preferably, each runner has at least one spring that acts with a tension opposite to the tension action of the strings on each runner.

In particular, said springs are located between a first stop, secured on said structural element, and a runner actuating member. More particularly, there is a second stop, secured on said structural element between said first stop and said runner actuating member, which limits the possibility of extension of the spring. This feature allows selection in such a way that the maximum length of the springs permitted by the device between said stops is less than the natural length of said springs at rest. This, in turn, ensures that the properties of the spring will not alter with use, as tends to happen when the springs are forced to work in extension, i.e. deforming in such a way as to exceed their natural length at rest.

According to a preferred embodiment of the invention, each runner is secured to a longitudinal rod, which in turn is connected to said runner actuating member. Preferably, each longitudinal rod moves through the inside of each spring arranged between the first stop and said actuating member. More preferably, each longitudinal rod moves through the inside of each spring arranged between the first and second stops.

According to another preferred embodiment of the invention, each runner is connected directly to said runner actuating member. Preferably, each runner moves along the outside of each spring, arranged between the first stop and said actuating member, by means of a system of ball bearings. More preferably, each runner moves along the outside of each spring, arranged between the first and second stops, by means of a system of ball bearings. In this way, a smooth movement of the runner with minimal friction is achieved.

Preferably, said runner selection mechanism engages with said runner actuating member, for example at one end of said member, allowing said runner actuation mechanism to act on said actuating member or said selection member, and therefore on the runner and the string corresponding to said actuating member.

According to a particular embodiment, the runner actuating member is a sleeve that surrounds the rod, the rod has at least one recess, the actuating member has at least one hole, and the selection mechanism surrounds the actuating member and has at least one housing, said rod, actuating member and selection mechanism having the ability to slide relative to one another, so that they present a position in which the recess, hole and housing coincide, there being a ball having the ability to be fully housed, alternatively between the recess and the hole or between the hole and the housing, in such a way that the ball is housed between the recess and the hole and the recess and the selection mechanism are located in such a way that the housing does not coincide with the hole, the ball serving as a transmitter of movements between the actuating member and the rod.

According to a particularly advantageous embodiment, said runner actuation mechanism comprises a slide carriage and two lateral guides for guiding the movements of said slide carriage, and an arm or lever and a cam for moving said slide carriage by pushing, by the actuation of an arm or lever, in both directions, along the path provided by said lateral guides.

According to another particularly advantageous embodiment, said runner actuation mechanism comprises a slide carriage that comprises, in turn, a transverse shaft between two lateral guides for guiding the movements of said slide, said transverse shaft having a cam to allow said slide carriage to be moved by pushing, by the actuation of a lever, in both directions, along the path provided by said lateral guides.

Preferably, each runner slides by means of a system of ball bearings.

BRIEF DESCRIPTION OF THE DRAWINGS

For a better understanding of the invention, some drawings of various embodiments of the present invention are attached by way of non-limitative explanatory example.

DETAILED DESCRIPTION OF THE PREFERRED EMBODIMENTS

FIGS. 1 to 9 show a first embodiment of a tremolo device -1- according to the present invention, arranged on the body -301- of a guitar -300-.

Said tremolo device -1- is formed by a structural element -10-, such as, for example, a flat structure made of metal plate that supports all of the separate elements comprised by said device -1-. Said structure -10- can be secured to the body -301- of the guitar -300- by means of securing elements such as, for example, threaded elements (-11-, -12-) arranged in the longitudinal sides of said structure -10-. Said threaded elements (-11-, -12-) may, in some cases, be inserted into pre-existing holes in the guitar provided for securing standard guitar bridges.

Additionally, said metal plate structure -10- is secured to the strap button -303- of the guitar -300- by means of a bracket -304-, also made of metal plate, that has an elongated hole -305- and a pin (not shown in the figures) for engaging with a hole -306- (see FIG. 5) provided in an end of the structure -10-. Said elongated hole -305- allows adjustment of the distance between the end of the structure -10- and the strap button -303-, which may vary according to the dimensions of the guitar -300- and the point of location of the device -1- with respect to the guitar -300-.

In addition, the structure -10- comprises, at the end opposite to the hole -306-, two elongated holes -13-, one on each side of the structure -10-, to allow the structure -10- to be secured to the guitar -300- by means of said threaded elements -12-. Said elongated holes -13- also allow variable adjustment of said structure -10- according to the dimensions of the guitar -300- and the point of location of the device -1- with respect to the guitar -300-.

The tremolo device -1- of this first embodiment comprises, in the end portion of the structure -10- nearest to the fingerboard or neck of the guitar -300-, five runners -40- arranged parallel to the longitudinal axis of the structure -10-. Each runner -40- is arranged on at least one longitudinal groove (not shown), arranged along the longitudinal axis of each runner -40-, that comprises at least one ball bearing (not shown) which allows the runner -40- to slide with minimal friction relative to its longitudinal axis.

On the end of each runner -40- nearest to the fingerboard or neck of the guitar -300- is provided a saddle -42- on which each string -302- respectively sits. Behind the saddle -42- and in said runner -40- is provided a pulley -41- for securing each string -302- to the runner -40-.

Figure 5:
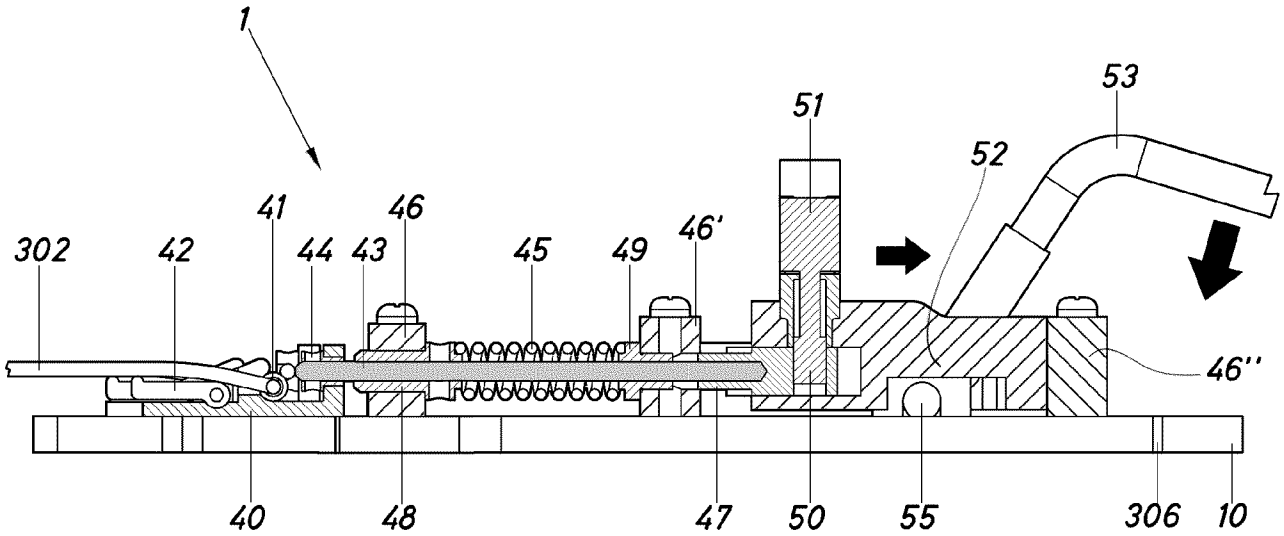
FIG. 5 shows a longitudinal sectional view of the tremolo device along the line V-V' of FIG. 4, according to the first mode of actuation illustrated in FIGS. 3 and 4.

The end portion of each runner -40- furthest from the fingerboard of the guitar -300- is secured respectively to a rod -43- parallel to the longitudinal axis of the device -1- by means of a coupling element -44-. Said rod -43-, as can be seen in FIG. 5, first passes through the through-hole of a first wall -46-, then passes inside a spring -45- arranged between said first wall -46- and a second wall -46'-, and finally said rod -43- passes through the through-hole of said second wall -46'-, and is then attached to an actuating end -47-. In this way, the string -302-, the runner -40- and the actuating end -47- act together by means of the rod -43-. Said rod -43- and the actuating end -47- form the actuation portion that transmits the actuations on each runner -40-. Additionally, the actuating end -47- comprises a hole suitable for the introduction of a pin -50- associated with a push-button -51- of a clutch device that allows the user to select in the device -1- which group of runners -40- will be actuated when the tremolo device -1- is used.

As mentioned in the preceding paragraph, said spring -45- is arranged between said first wall -46- and said second wall -46'-. The ends of said spring -45- are secured respectively to two ferrules (-48-, -49-), each ferrule having a collar with a larger diameter than the rest of the ferrule. The diameter of said collars is greater than that of said through-holes of said walls -46-, -46'-, so that the spring -45- is trapped between said walls -46-, -46'-, limiting the possibility of extension of said spring -45-.

Additionally, the smaller diameter of each respective circular section of each ferrule (-48-, -49-) has a suitable diameter to be capable of passing through the through-holes of said walls -46-, -46'-. The ferrule -48-, in this first embodiment, comprises in its smaller-diameter section a threaded area for engaging with a mating threaded area in the through-hole of the wall -46-. Said ferrule -48- serves as a fixed stop for the spring -45-. At the other end of the spring -45-, the smaller-diameter circular section of the ferrule -49- passes through the inside of the through-hole until the collar of said ferrule -49- abuts against the wall -46'-. It should be noted that the rod -43- runs through the inside of the ferrules -47-, -48- and the spring -45- without any contact with said components, and therefore without suffering any friction.

Figure 1:
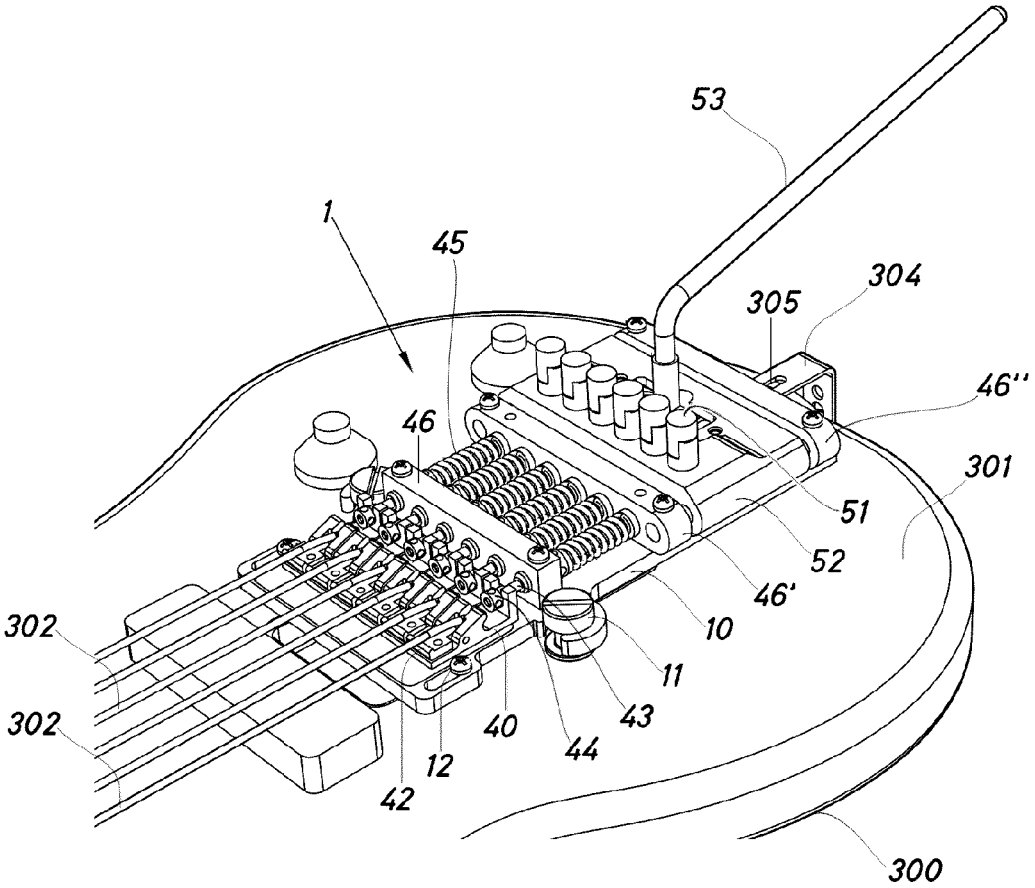
FIG. 1 shows a perspective view of a tremolo device at rest according to a first embodiment of the present invention, arranged on the body of a guitar.
Figure 2:
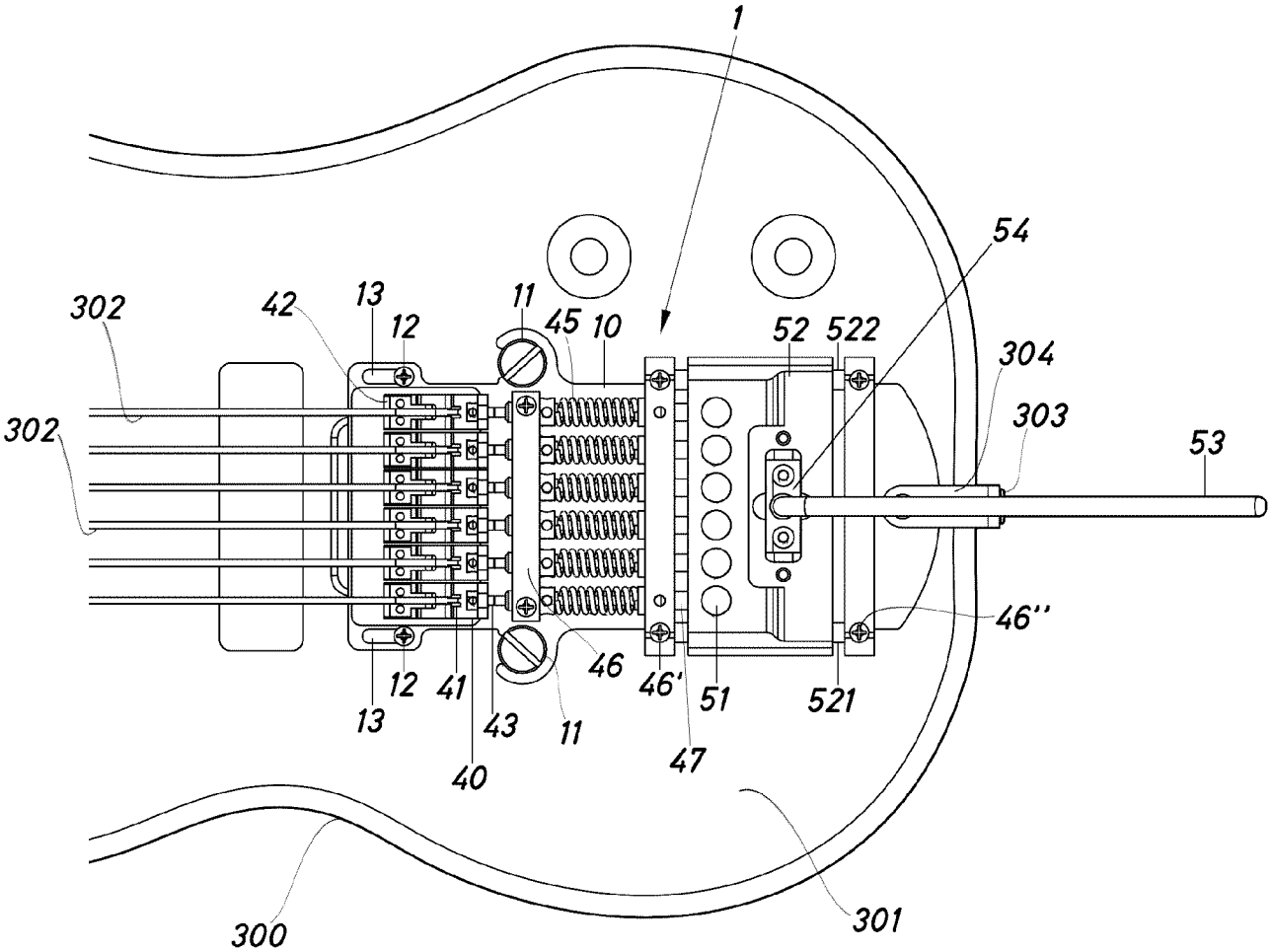
FIG. 2 shows a plan view of the first embodiment of the tremolo device illustrated in FIG. 1.
Figure 8:
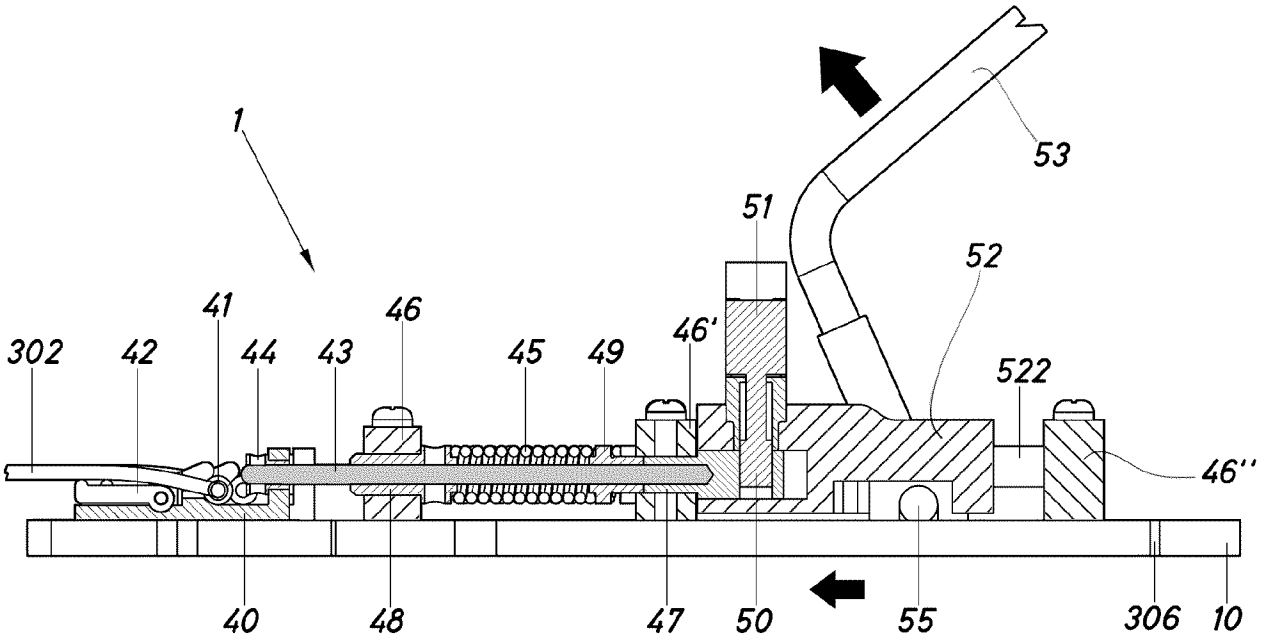
FIG. 8 shows a longitudinal sectional view of the tremolo device along the line VIII-VIII' of FIG. 7, according to the second mode of actuation of the same illustrated in FIGS. 6 and 7.

When the ferrule -49- comes into contact with the actuating end -47-, as can be seen in FIG. 8, the spring -45- is compressed by the action of the tension of the string -302-, said spring -45- exerting an action in the direction towards the device -1- contrary to the action exerted by the strings -302-. If the tremolo device -1- is not actuated (i.e. is at rest, as illustrated in FIGS. 1 and 2), an equilibrium is established between the tension of the strings -302- and the force exerted by each of the respective springs -45- in their compressed state.

The location of the spring -45- between two walls (-46-, -46'-) defining two stops makes it possible to limit the travel of the spring -45-, especially when the tremolo device -1- is actuated, ensuring that the spring -45- always works in the compression position, which facilitates the maintenance of the tuning (constant tuning) of the guitar after repeated actuation of the tremolo device -1-. Additionally, the wall -46'- that limits the possibility of extension of the spring -45- considerably reduces the frequency of extensions of said spring, allowing a longer useful life for each spring -45- in the device -1-.

As can be seen in FIGS. 1 to 9, the structure -10- also comprises a slide carriage -52- arranged as a continuation of the described assembly. Said slide carriage -52- can move through a limited travel between said second wall -46'- and a third wall -46"- along two lateral guides (-521-, -522-) parallel to the transverse axis of said slide -52-.

Additionally, said slide carriage -52- comprises push-buttons -51- corresponding to each runner -40- to allow individual selection of each string -302- that it is desired to actuate with the tremolo device -1-. In the resting position and without any push-button -51- activated (FIGS. 1 and 2), the tremolo device -1- is adjusted so that the pins -50- of the respective push-buttons -51- are arranged just above the respective holes of the respective securing elements -47- corresponding to each string -302-.

Figure 9:
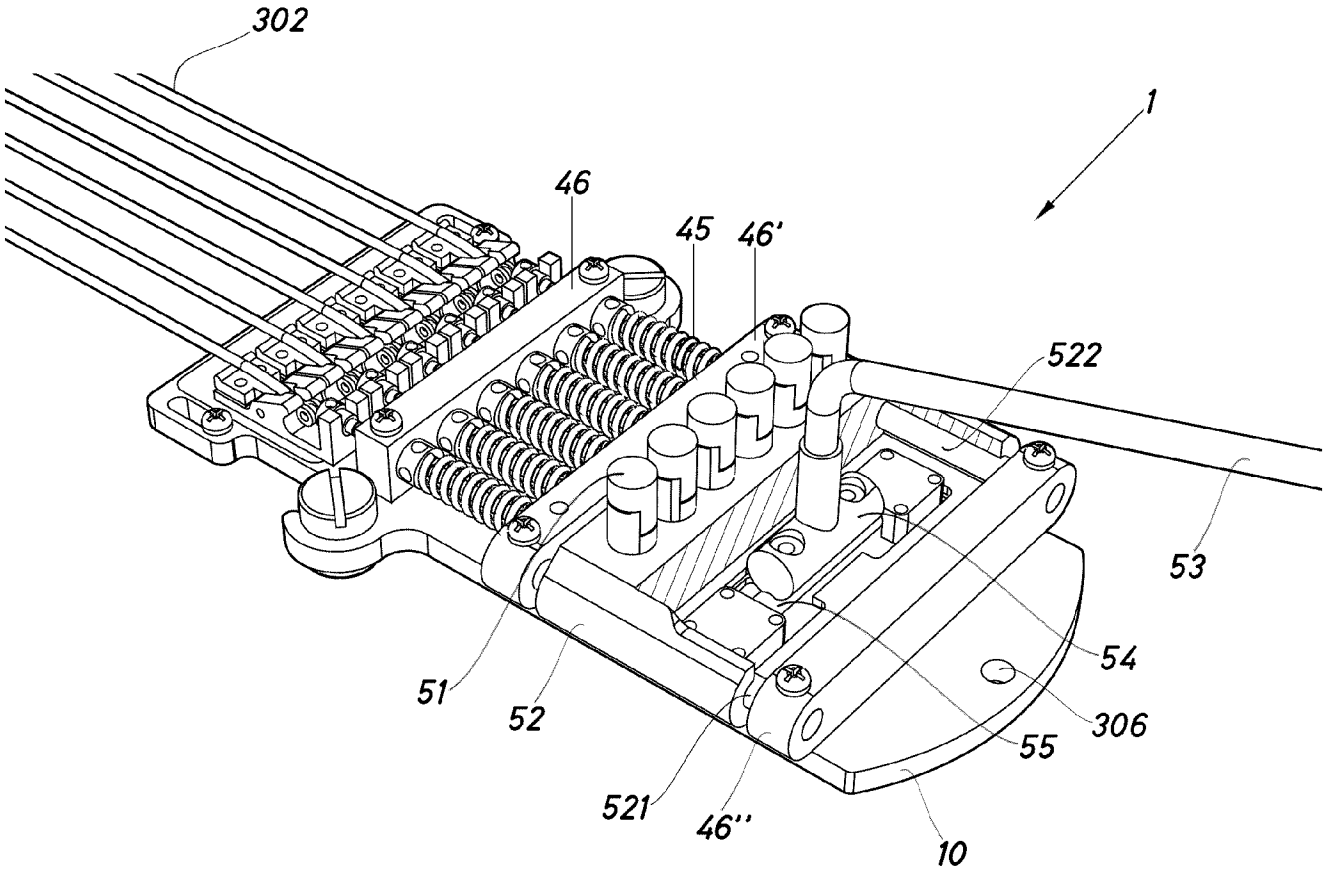
FIG. 9 shows a perspective view of the tremolo device at rest of FIGS. 1 and 2, illustrating the detail of the lever actuation mechanism.

As can be seen in FIG. 9, a transverse shaft -55- is arranged between the lateral guides (-521-, -522-). On said shaft -55- is provided a cam -54- which moves the slide carriage -52- by pushing, by the actuation of a lever -53-, in both directions along the path provided by the lateral guides (-521-, -522-).

As mentioned previously, FIGS. 1 and 2 show the tremolo device -1- according to a first embodiment in the resting state. In this state, each string -302-, secured to its respective pulley -41- of its respective saddle -42-, pulls, in turn, on the runner -40-, the rod -43- and the actuating end -47- corresponding to each string -302-. However, the actuating end -47- abuts, due to its smaller-diameter circular section, with the ferrule -49- of the end of the spring -45-, establishing an equilibrium between said string -302- and the corresponding spring -45-. Thus, a point of equilibrium is achieved that maintains the tuning of the strings and makes it possible to act directly on the arm -53- of the tremolo device -1- without any need to lock and unlock said device -1-.

Figure 3:
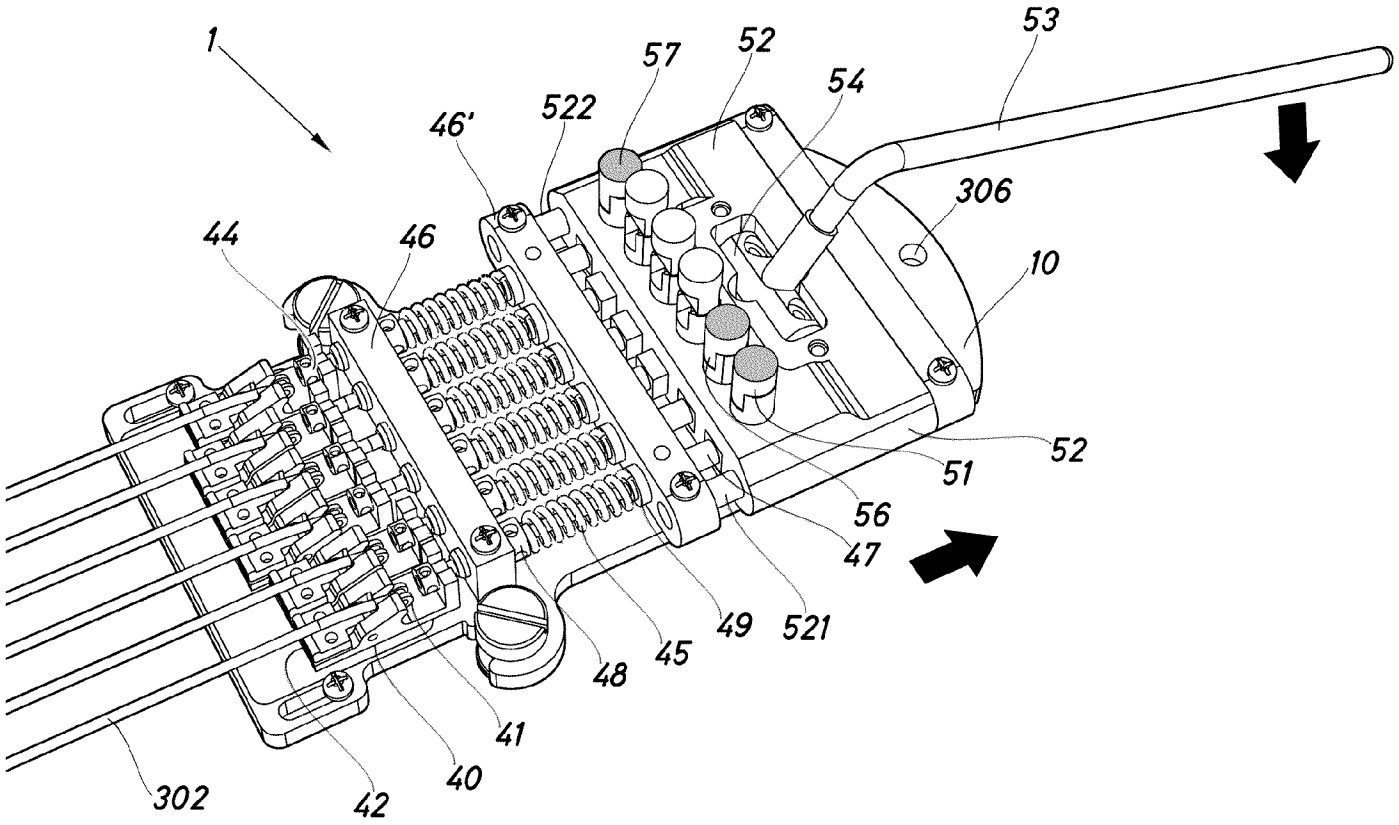
FIG. 3 shows a perspective view of the first embodiment of a tremolo device according to a first mode of actuation.
Figure 4:
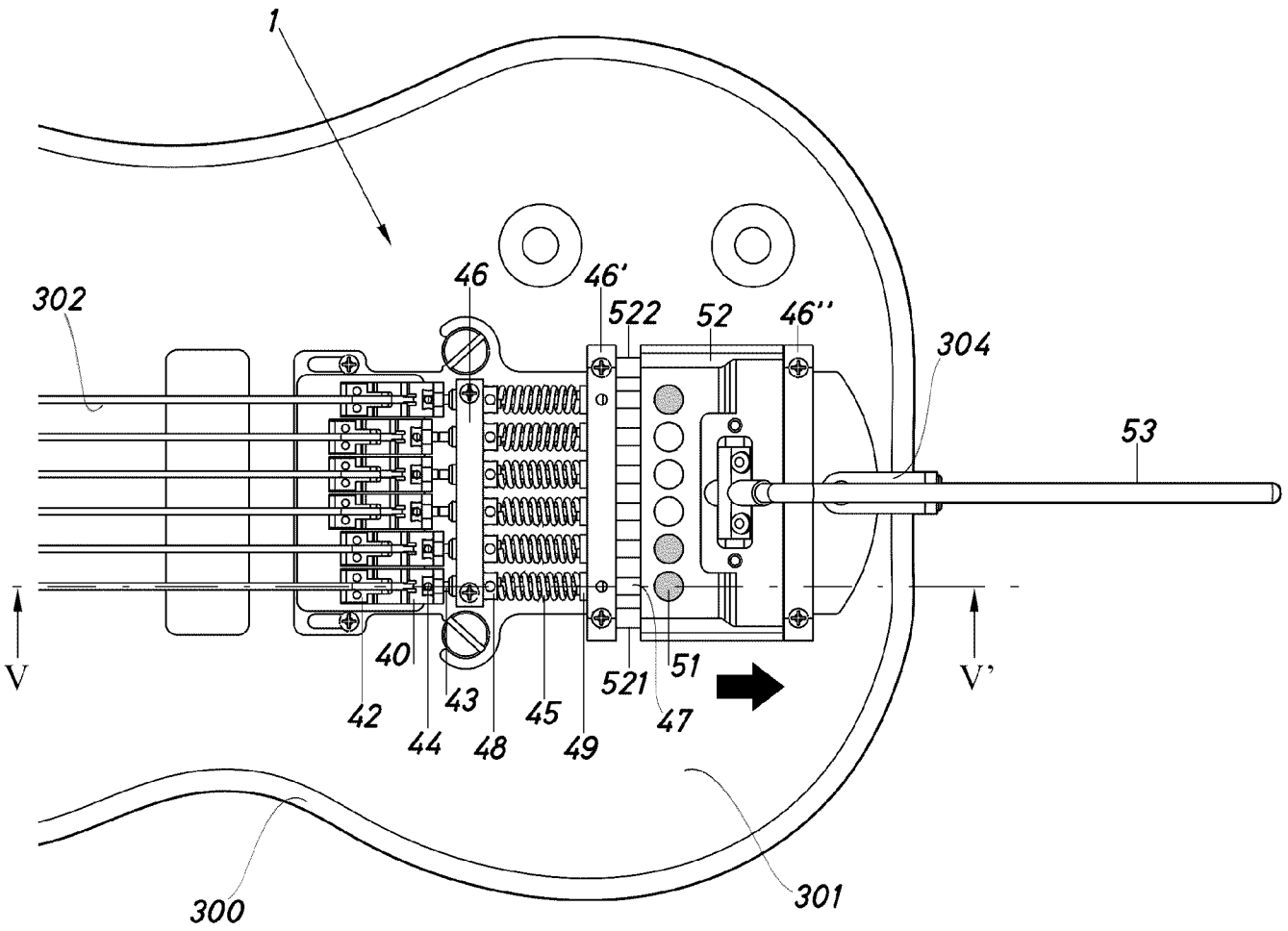
FIG. 4 shows a plan view of the first embodiment of a tremolo device according to the first mode of actuation illustrated in FIG. 3.

FIGS. 3 to 5 show a first mode of operation (actuation of the device -1- to increase the tension of the strings -302-) of the tremolo device -1- according to the present invention. For this mode of operation, only the operation of the push-button -51- will be explained, while the push-buttons -56- and -57- also selected, as shown in FIG. 5, also work in the same way as the push-button -51-. When the end of the arm -53- of the slide carriage -52- is pressed in the direction towards the wall -46"-, the cam -54- moves the slide carriage -52-, guided by its lateral guides (-521-, -522-), towards the wall -46"-. The push-button -51-, by means of its respective pin -50-, moves the actuating end -47-, and consequently the rod -43- and the runner -40-, in the direction of the wall -46"-, further tensioning the string -302-.

Figure 6:
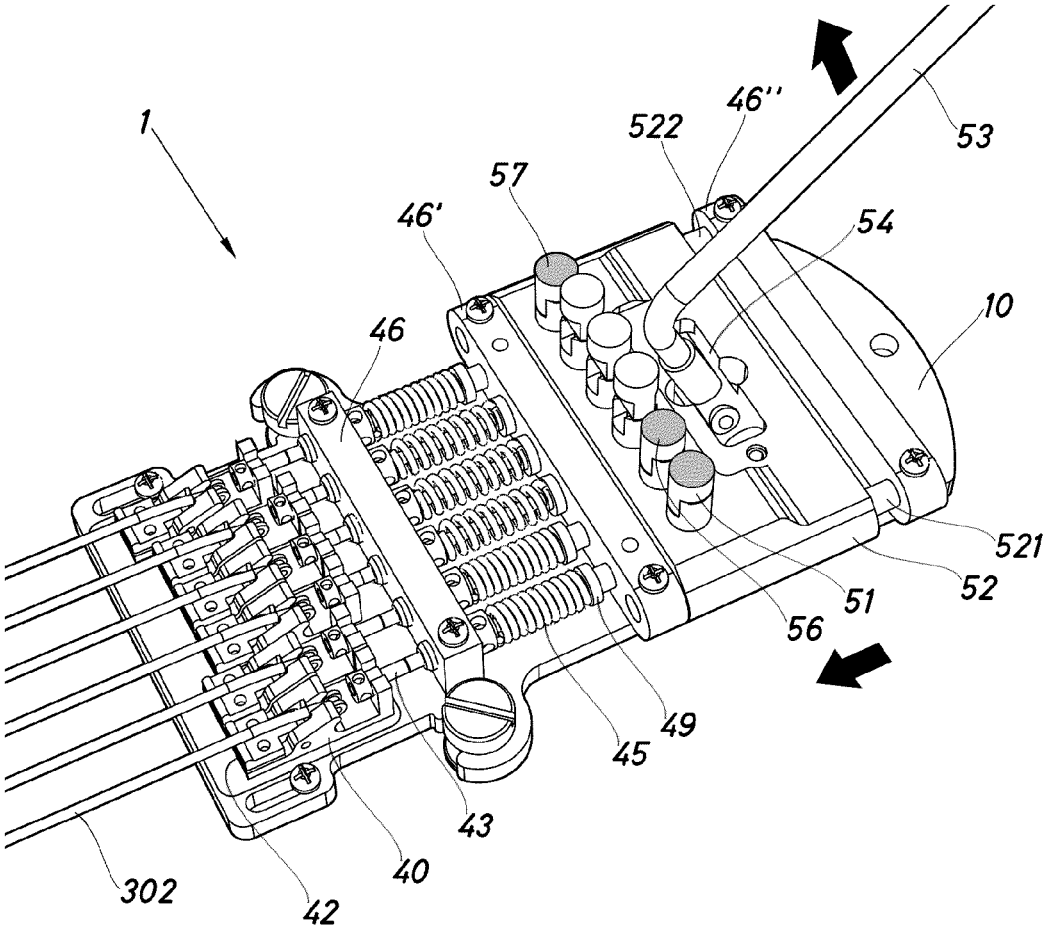
FIG. 6 shows a perspective view of the first embodiment of a tremolo device, according to a second mode of actuation.
Figure 7:
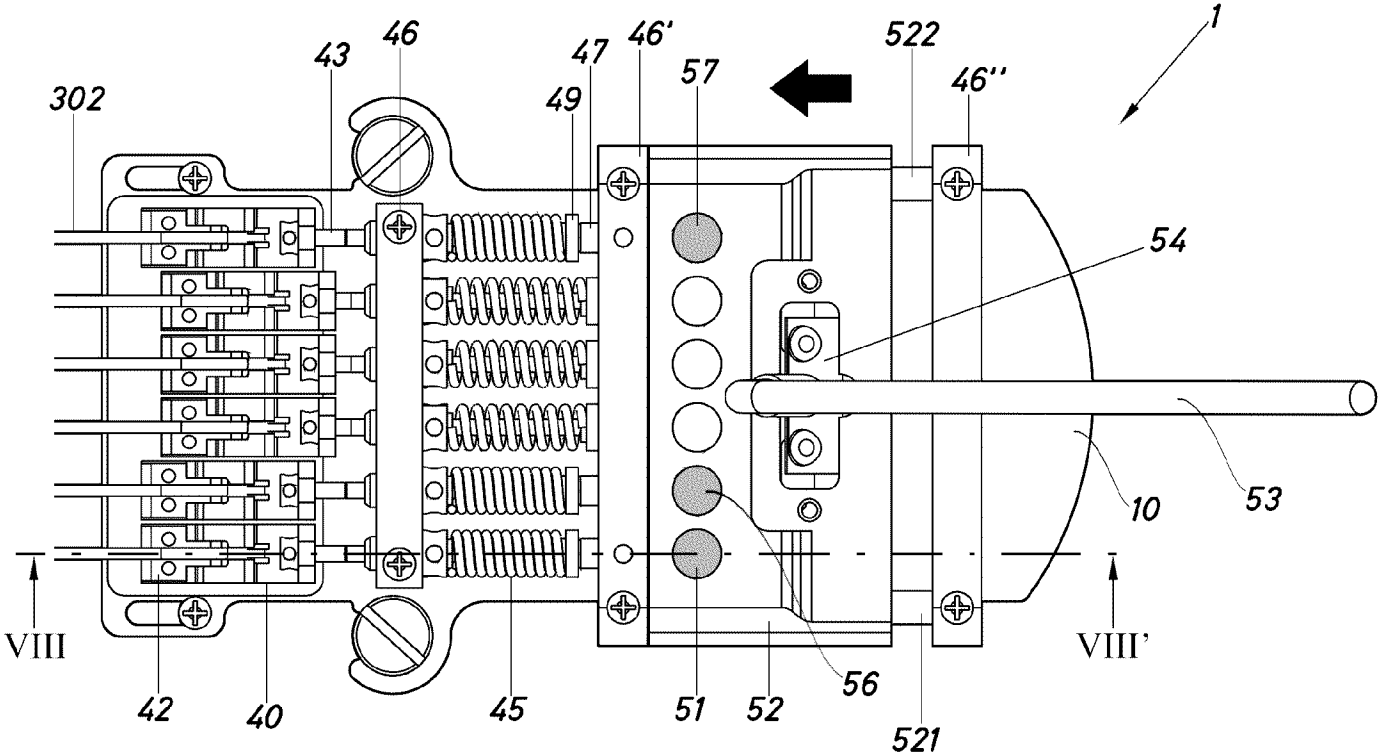
FIG. 7 shows a plan view of the first embodiment of a tremolo device, according to the second mode of actuation illustrated in FIG. 6.

FIGS. 6 to 8 show a second mode of operation (actuation of the device -1- to decrease the tension of the strings -302-)

of the tremolo device -1- according to the present invention. For this second mode of operation, only the operation of the push-button -51- will be explained, while the push-buttons -56- and -57- also selected, as shown in FIG. 6, also work in the same way as the push-button -51-. When the end of the arm -53- of the slide carriage -52- is pressed in the direction towards the wall -46'-, the cam -54- moves the slide carriage -52-, guided by its lateral guides (-521-, -522-), towards the wall -46'-. The push-button -51-, by means of its respective pin -50-, moves the actuating end -47- in the direction towards the wall -46-. At this time, the actuating end -47-, on one hand, causes the shaft -43- and the runner -40- to move in the direction towards the fingerboard of the guitar -300-, resulting in a slackening of the string -302-, and, on another hand, said actuating end -47- pushes the ferrule -49-, causing the spring -45- to be compressed.

FIGS. 10 to 17 show a second embodiment of a tremolo device -2- according to the present invention, arranged on the body -301- of a guitar -300-.

Said tremolo device -2- is formed by a structural element -20-, such as, for example, a flat structure made of metal plate that supports all of the separate elements comprised by said device -2-. Said structure -20- can also be secured to the body -301- of the guitar -300- in the same way (by means of a bracket, threaded elements and elongated holes) as in the first embodiment of the device -1-, allowing variable adjustment of said structure -20- according to the dimensions of the guitar -300- and the point of location of the device -2- with respect to the guitar -300-.

In this second embodiment, the tremolo device -2- comprises five longitudinal -70- platens arranged parallel to the longitudinal axis of the structure -20-. Each platen -70- is arranged on at least one longitudinal groove (not shown), arranged along the longitudinal axis of each platen -70-, that comprises ball bearings (not shown) which allow the platen -70- to slide with minimal friction relative to its longitudinal axis.

On the end of each platen -70- nearest to the fingerboard or neck of the guitar -300- a saddle -75- is provided on which each string -302- respectively sits by means of its corresponding pulley for securing each string -302-. As can be seen in the sectional view of FIG. 14, the opposite end of each longitudinal platen -70-, according to this second embodiment, comprises a hole suitable for the introduction of a pin -81- of a push-button -66- of a clutch device that allows the user to select in the device -2- which platens -70- will be actuated when the tremolo device -2- is used.

Additionally, between the two ends of each platen -70- and above each of them is arranged a slide carriage -60- with springs -71-, in such a way that each spring -71- is arranged above each platen -70-. Each spring -71- is arranged between a first wall -61- and a second wall -62- of the slide carriage -60-. In this case, the ends of said spring -71- are also secured respectively to two ferrules (-73-, -68-), each ferrule having a collar with a larger diameter than the rest of said ferrule. The diameter of the collars is greater than that of said through-holes of said walls (-61-, -62-), so that each spring -71- is trapped between said walls (-61-, -62-).

Additionally, the smaller diameter of each respective circular section of each ferrule (-73-, -68-) has a suitable diameter to be capable of passing through the through-holes of said walls (-61-, -62-). The ferrule -73-, according to this second embodiment, comprises in its smaller-diameter section a threaded area intended to engage with a mating threaded area in the through-hole of the wall -61-. Said ferrule -73- serves as a fixed stop for the spring -71-. At the other end of the spring -71-, the smaller-diameter circular section of the ferrule -68- can pass through the inside of the through-hole of the wall -62- of the slide carriage -60- until a larger-diameter collar abuts against the wall -62-. Additionally, said ferrule -68-, at its smaller-diameter circular section end, is threaded into another ferrule -63-, which serves, in turn, as a stop with a quadrangular projection -64- arranged on the platen -70- between said ferrule -63- and the push-button -66-.

Figure 10:
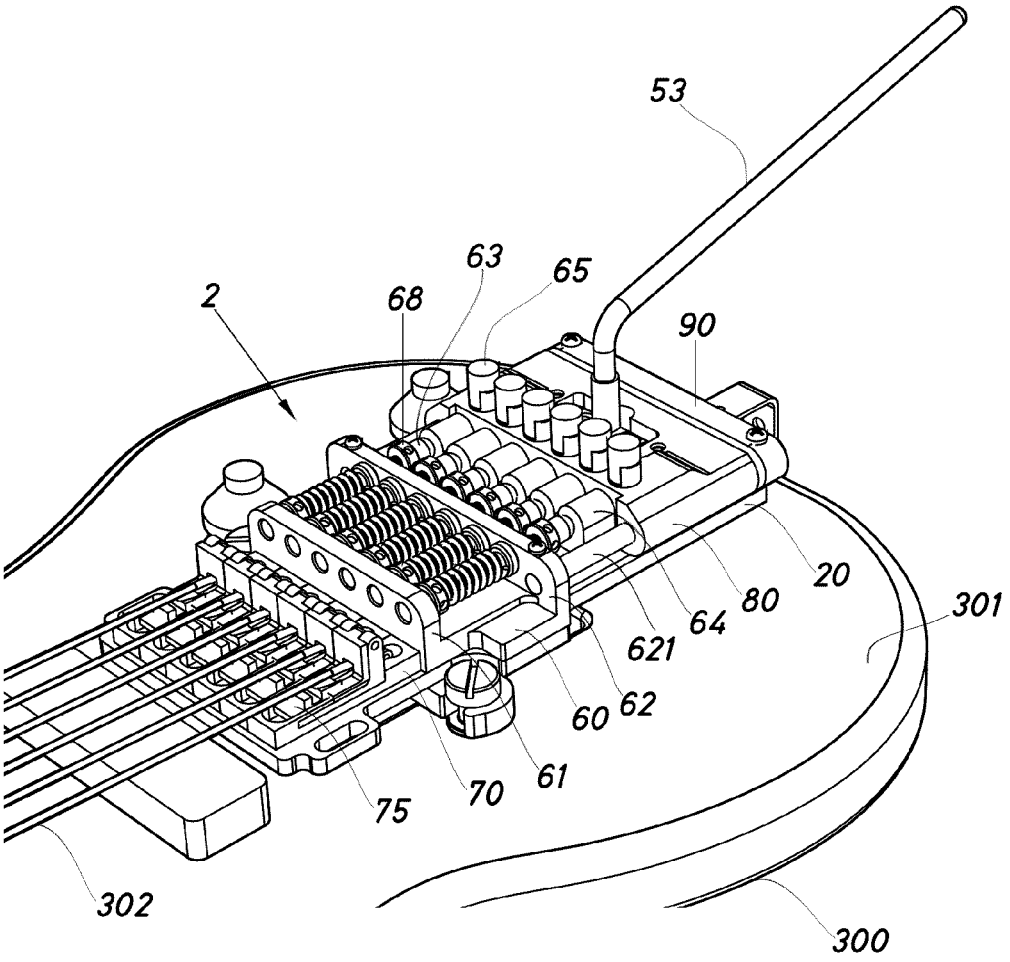
FIG. 10 shows a perspective view of a tremolo device at rest according to a second embodiment of the present invention, arranged on the body of a guitar.
Figure 11:
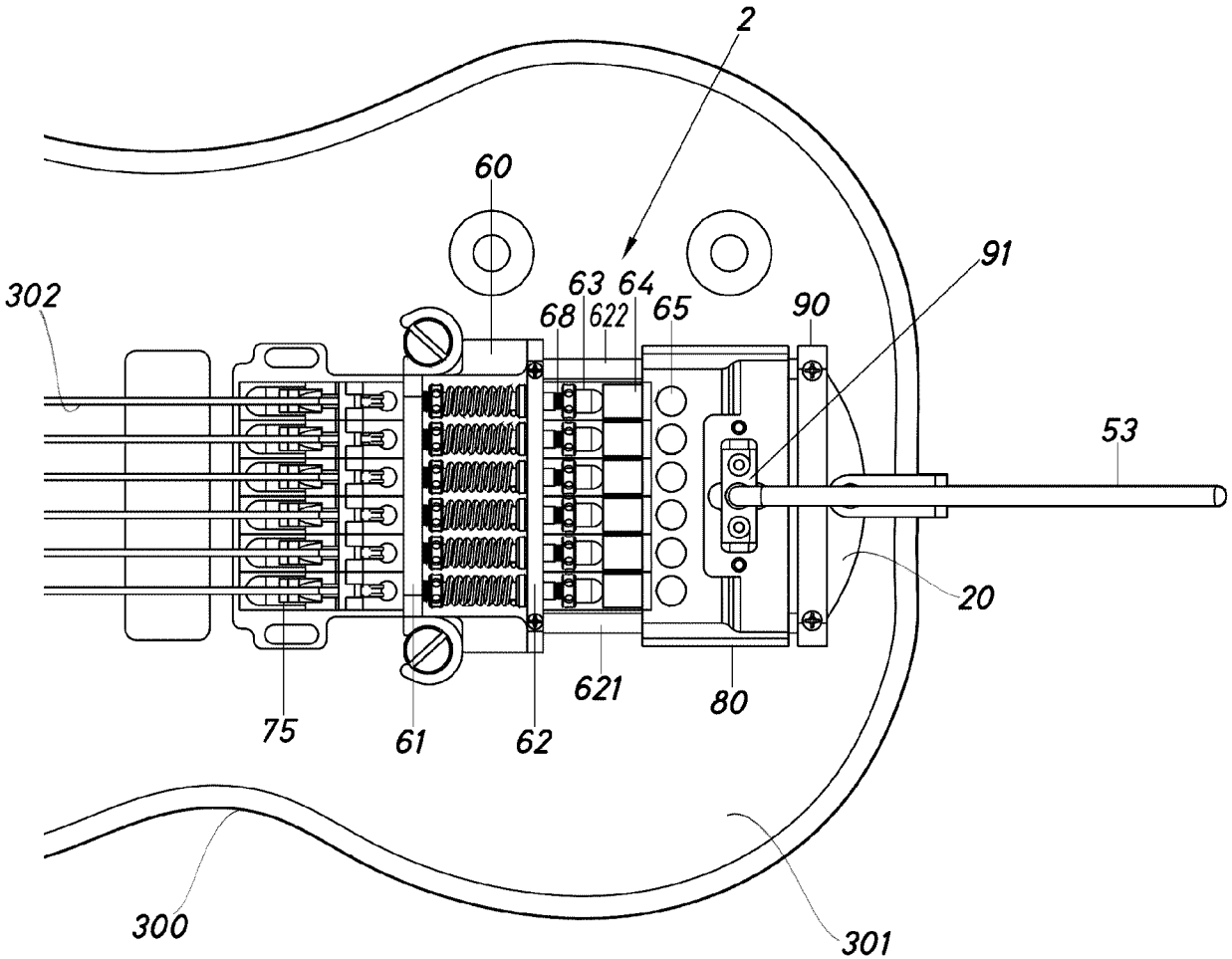
FIG. 11 shows a plan view of the second embodiment of the tremolo device illustrated in FIG. 10.
Figure 17:
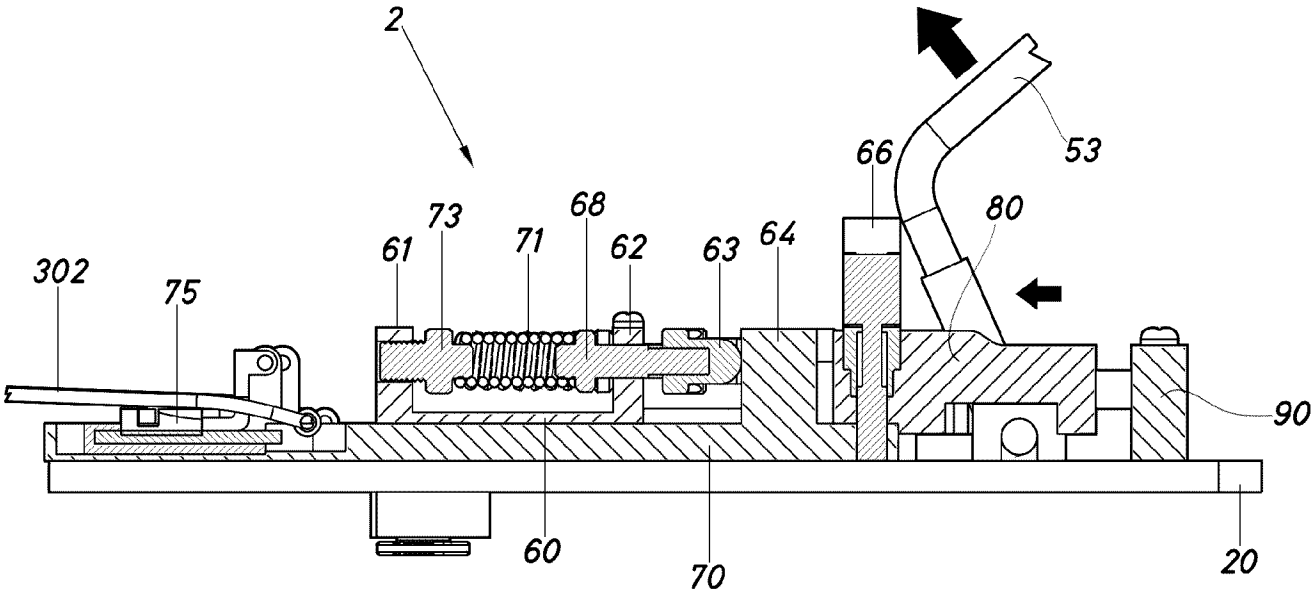
FIG. 17 shows a longitudinal sectional view of the tremolo device along the line XVII-XVII' of FIG. 16, according to a second mode of actuation illustrated in FIGS. 15 and 16.

When the quadrangular projection -64- comes into contact with the ferrule -63-, as can be seen in FIG. 17, the spring -71- is compressed by the action of the tension of the string -302-, said spring -71- exerting an action in the direction towards the device -2- contrary to the action exerted by the strings -302-. If the tremolo device -2- is not actuated (i.e. is at rest, as illustrated in FIGS. 10 and 11), an equilibrium is established between the tension of the strings -302- and the force exerted by each of the respective springs -71- in their compressed state.

Once again, the location of the spring -71- between two walls (-61-, -62-) defining two stops makes it possible to limit the travel of the spring -71-, especially when the tremolo device -2- is actuated, ensuring that the spring -71- always works in the compression position, which facilitates the maintenance of the tuning (constant tuning) of the guitar after repeated actuation of the tremolo device -2-. Additionally, the wall -62- that limits the possibility of extension of the spring -71- considerably reduces the frequency of extensions of said spring, allowing a longer useful life for each spring -71- in the device -2-.

As can be seen in FIGS. 10 to 17, the structure -20- also comprises a slide carriage -80- arranged as a continuation of the quadrangular projection -64-. Said slide carriage -80- can move through a limited travel between the walls (-62-, -90-), along two lateral guides (-621-, -622-) parallel to the transverse axis of said slide carriage -80-.

Additionally, said slide carriage -80- comprises push-buttons -65- corresponding to each platen -70- to allow individual selection of each string -302- that it is desired to actuate with the tremolo device -2-. In the resting position and without any push-button -65- activated, the tremolo device -2- is adjusted so that the pins -80- of the respective push-buttons -65- are arranged just above the respective holes in the ends of the platens -70- corresponding to each string -302-.

According to this second embodiment, a transverse shaft is arranged between the lateral guides (-621, -622-). On said shaft a cam -91- is provided which moves the slide carriage -80- by pushing, by the actuation of a lever -53-, in both directions on the lateral guides (-621-, -622-).

As mentioned previously, FIGS. 10 and 11 show the tremolo device -2- according to a second embodiment and in the resting state. In this state, each string -302-, secured to its respective pulley of its respective platen -70-, pulls, in turn, on said platen -70- along its entire length, and consequently also pulls on the quadrangular projection -64- arranged on the platen -70-. However, said quadrangular projection -64- abuts with the joined ferrules (-62-, -63-), establishing an equilibrium between said string -302- and the corresponding spring -71-, thus achieving a point of equilibrium that maintains the tuning of the strings and makes it possible to act directly on the arm -53- of the tremolo device -2- without any need to lock and unlock said device -2-.

Figure 12:
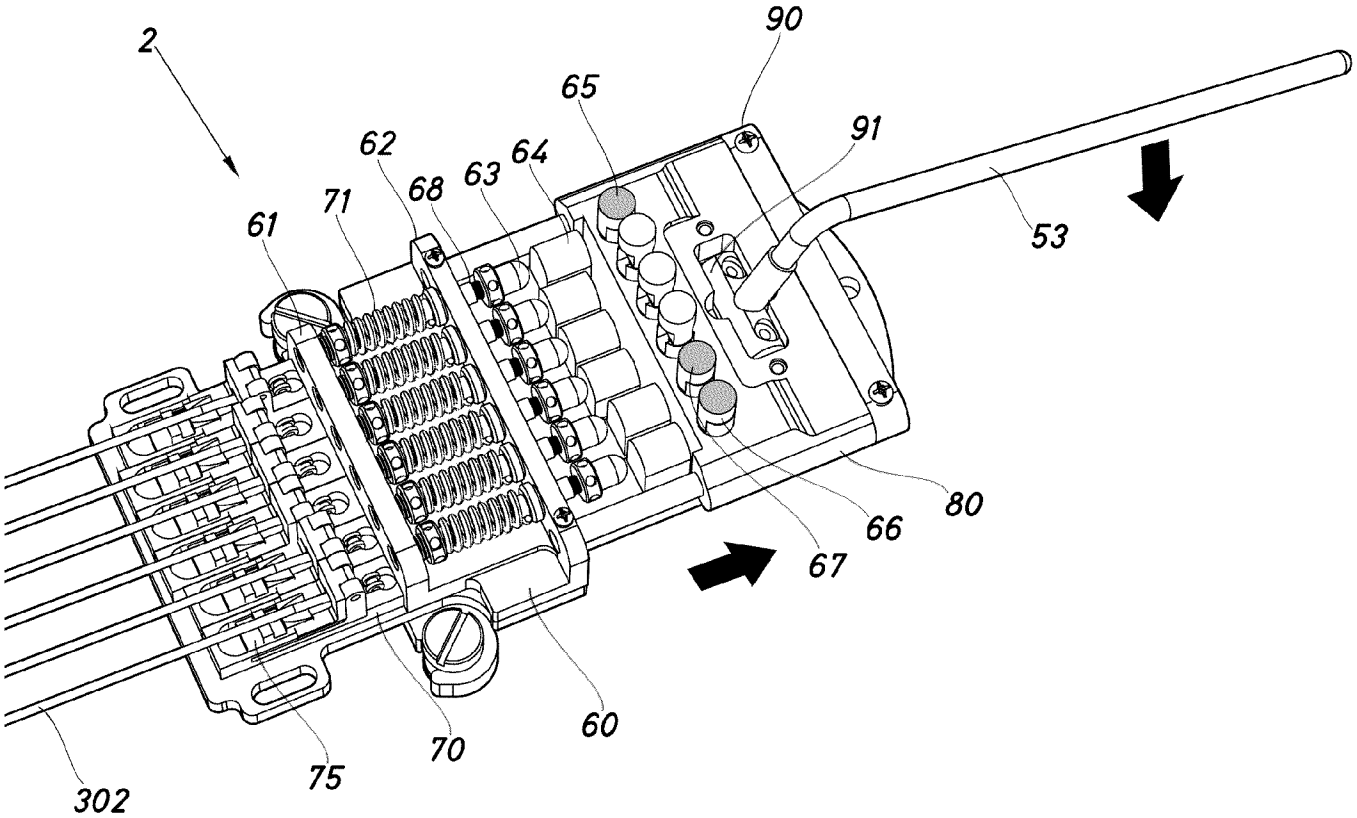
FIG. 12 shows a perspective view of the second embodiment of a tremolo device, according to a first mode of actuation.
Figure 13:
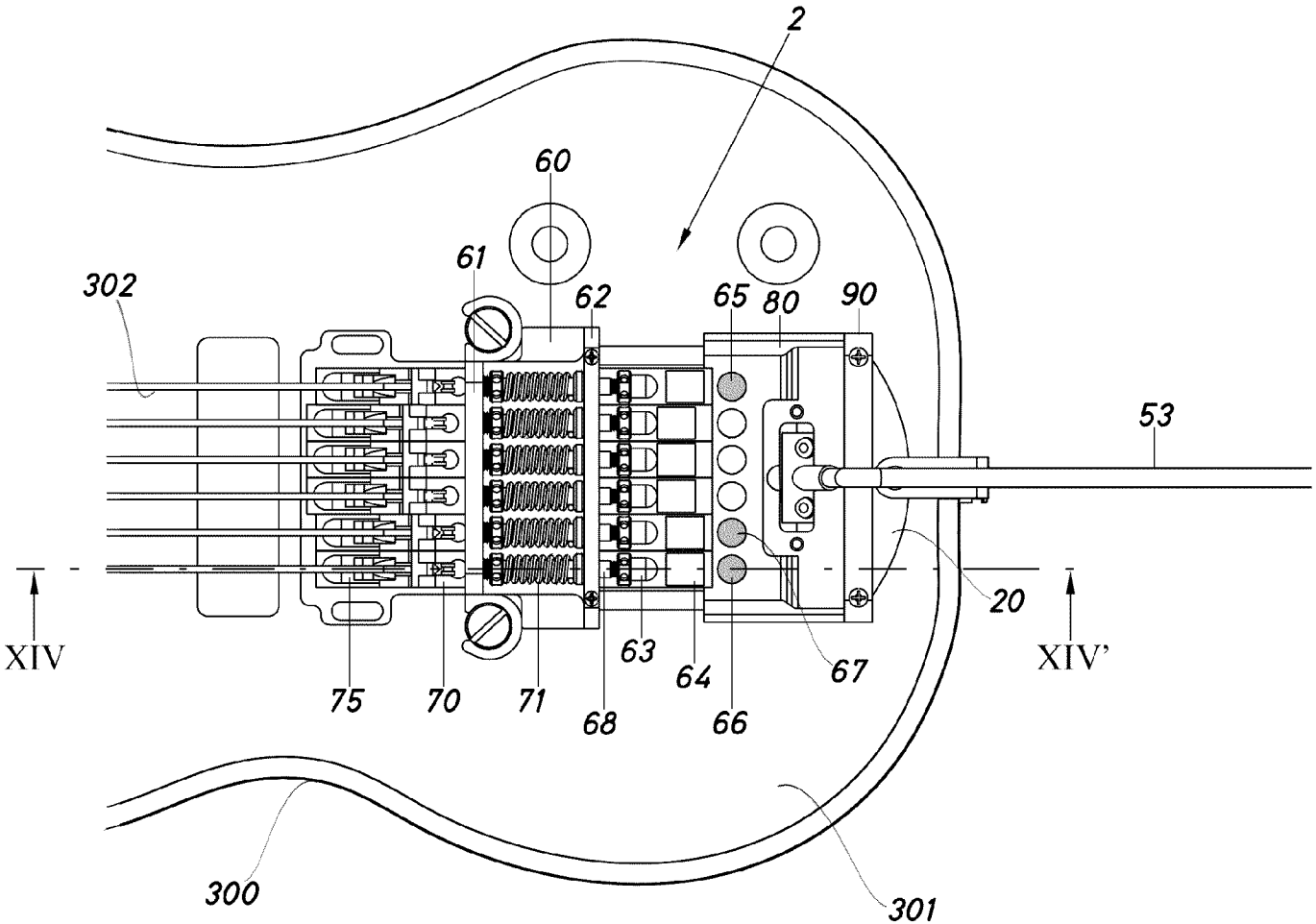
FIG. 13 shows a plan view of the second embodiment of a tremolo device, according to a first mode of actuation.
Figure 14:
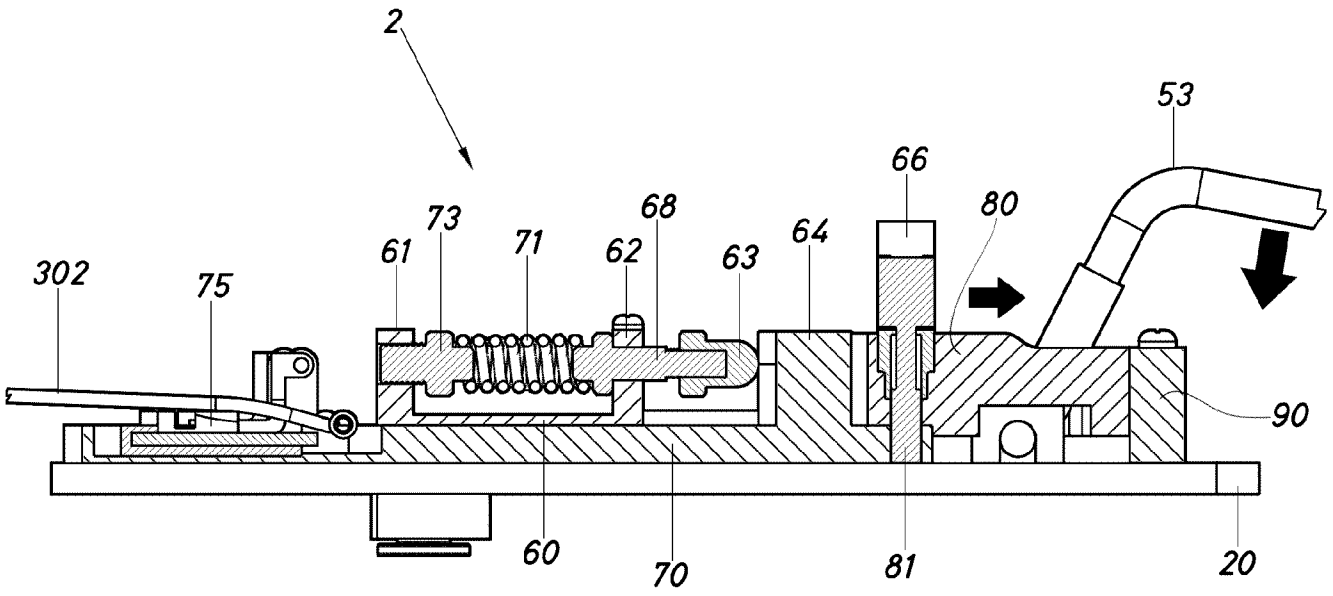
FIG. 14 shows a longitudinal sectional view of the tremolo device along the line XIV-XIV' of FIG. 13, according to a first mode of actuation.

FIGS. 12 to 14 show a first mode of operation (actuation of the device -2- to increase the tension of the strings -302-) of the tremolo device -2- according to the present invention. For this mode of operation, only the operation of the push-button -66- will be explained, while the push-buttons -65- and -67- also selected, as shown in FIG. 12, also work in the same way as the push-button -66-. When the end of the arm -53- of the slide carriage -80- is pressed towards the wall -90-, the cam -90- moves the slide carriage -80-, guided by the lateral guides (-621-, -622-), towards the wall -90-. The push-button -66-, by means of its respective pin -81-, moves the platen -70- in the direction of the wall -90-, further tensioning the string -302-.

Figure 15:
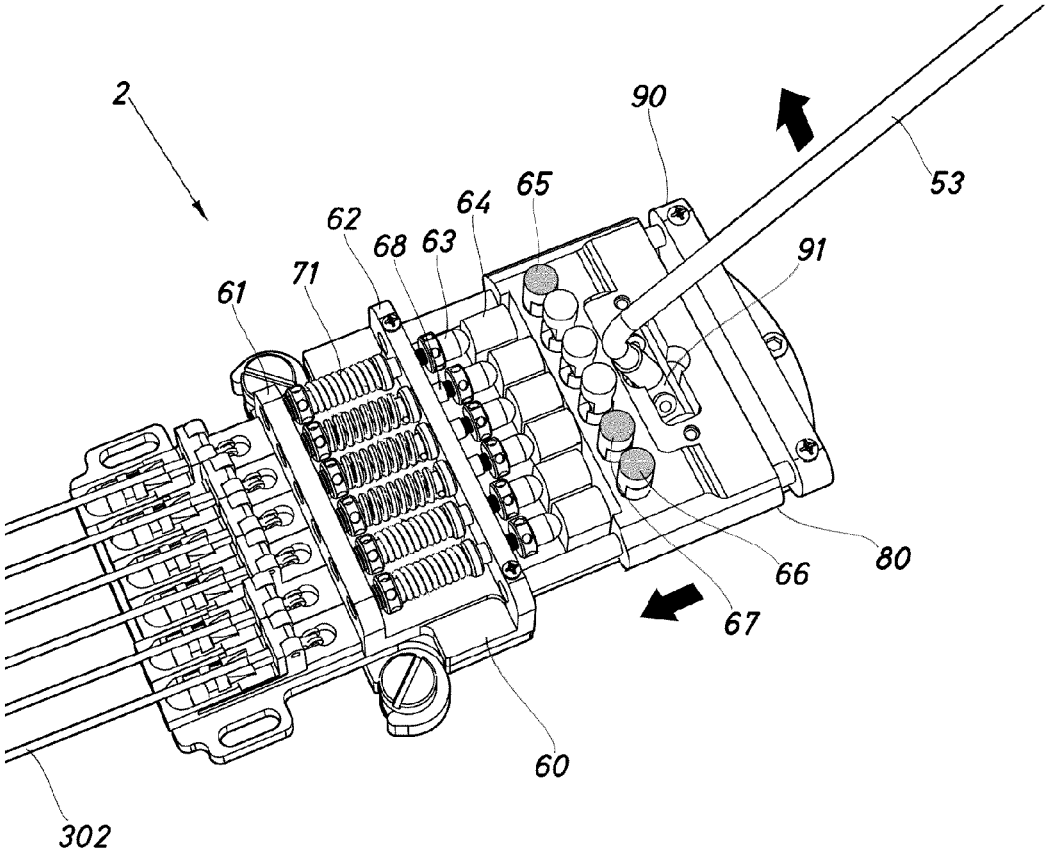
FIG. 15 shows a perspective view of the second embodiment of a tremolo device, according to a second mode of actuation.
Figure 16:
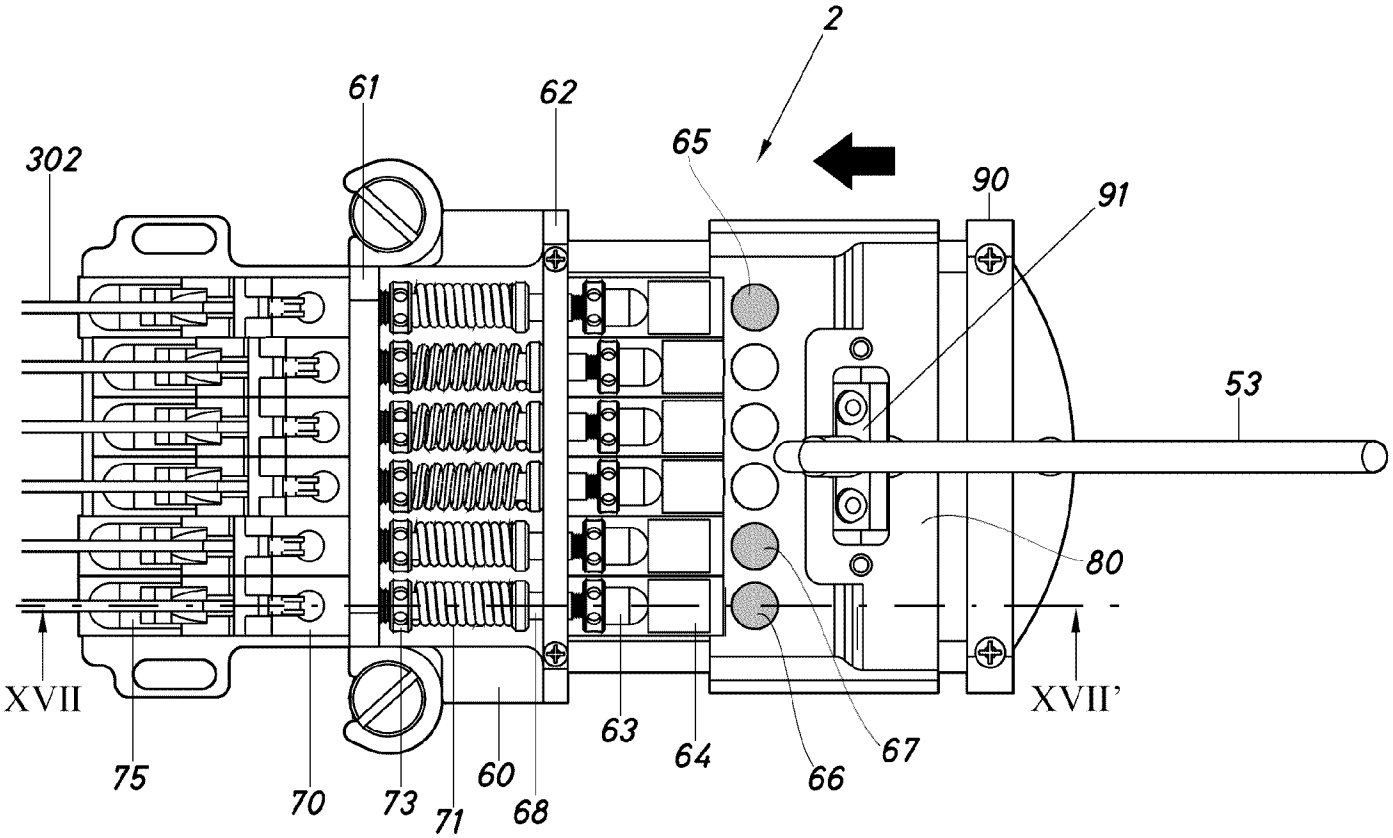
FIG. 16 shows a plan view of the second embodiment of the tremolo device, according to the second mode of actuation illustrated in FIG. 15.

FIGS. 15 to 17 show a second mode of operation (actuation of the device -2- to decrease the tension of the strings -302-) of the tremolo device -2- according to the present invention. For this mode of operation, only the operation of the push-button -66- will be explained, while the push-buttons -65- and -67- also selected, as shown in FIG. 15, also work in the same way as the push-button -66-. When the end of the arm -53- of the slide carriage -80- is pressed in the direction towards the wall -62-, the cam -90- moves the slide carriage -80-, on its lateral guides (-621-, -622-), towards the wall -62-. The push-button -66-, by means of its respective pin -81-, moves the platen -70- in the direction of the wall -62-. At this time, the quadrangular projection -64- joined to the platen -70- causes, on one hand, said platen to move in the direction towards the fingerboard of the guitar -300-, resulting in a slackening of the string -302-, and, on another hand, said quadrangular projection -64- pushes the joined ferrules (-62-, -63-), causing the spring -71- to be compressed.

FIGS. 18 to 24 show a third embodiment of the device of the present invention, which has more compact dimensions.

In the figures, elements that are the same as or equivalent to those shown in the previous examples have been identified with the same numerals and will therefore not be described in depth.

Unlike the previous examples, only the tremolo device is shown in FIGS. 18 to 24, with no illustration of the guitar or the strings, which would remain joined to the runners -40-.

As can be seen in the figures, the embodiment of FIGS. 18 to 24 is similar to that of FIGS. 1 to 8 with regard to the arrangement of the runners -40-, the runner actuating rod -43-, the springs -45- and the walls -46-, -46'-, but with differences with regard to the push-buttons -51- of the clutch system, which in this case are sliding selectors, the clutch system itself, the spatial arrangement of the arm -53-, the slide carriage -52- and the structure of the clutch.

Figure 18:
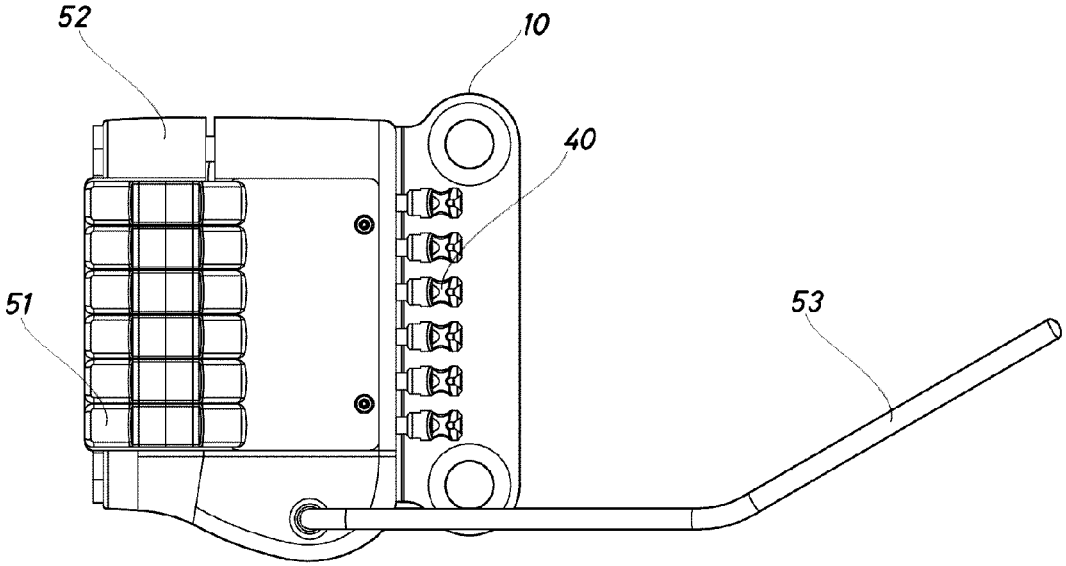
FIG. 18 shows a top plan view of a third embodiment of the tremolo device, whose layout gives it a more compact arrangement.
Figure 19:
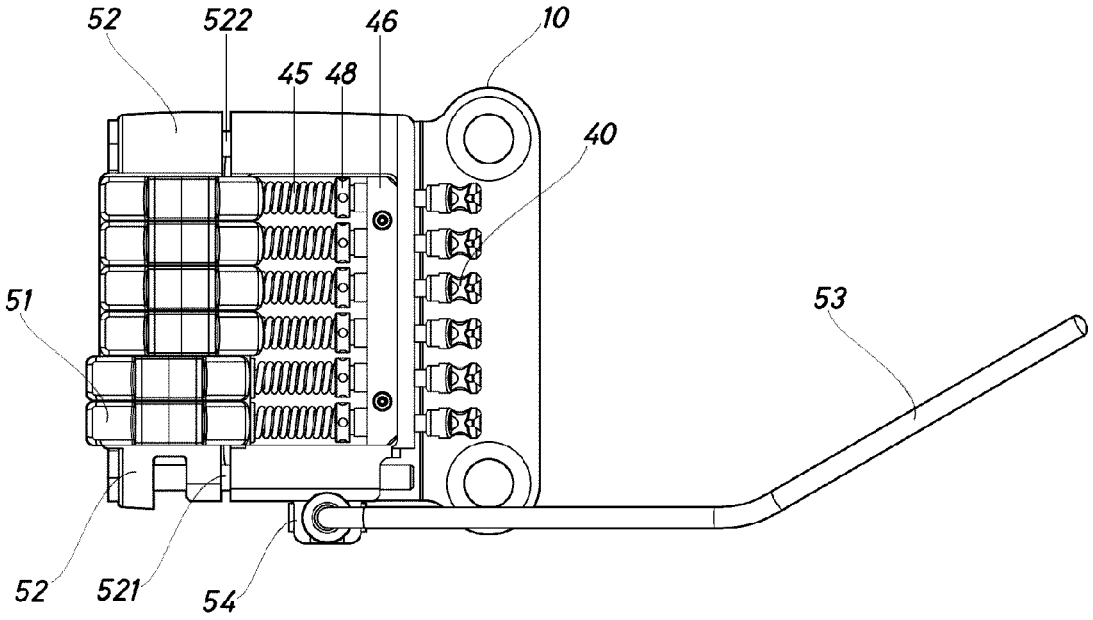
FIG. 19 shows a top plan view of the example of the previous figure, wherein end caps have been removed to expose mechanical elements of the device.
Figure 20:
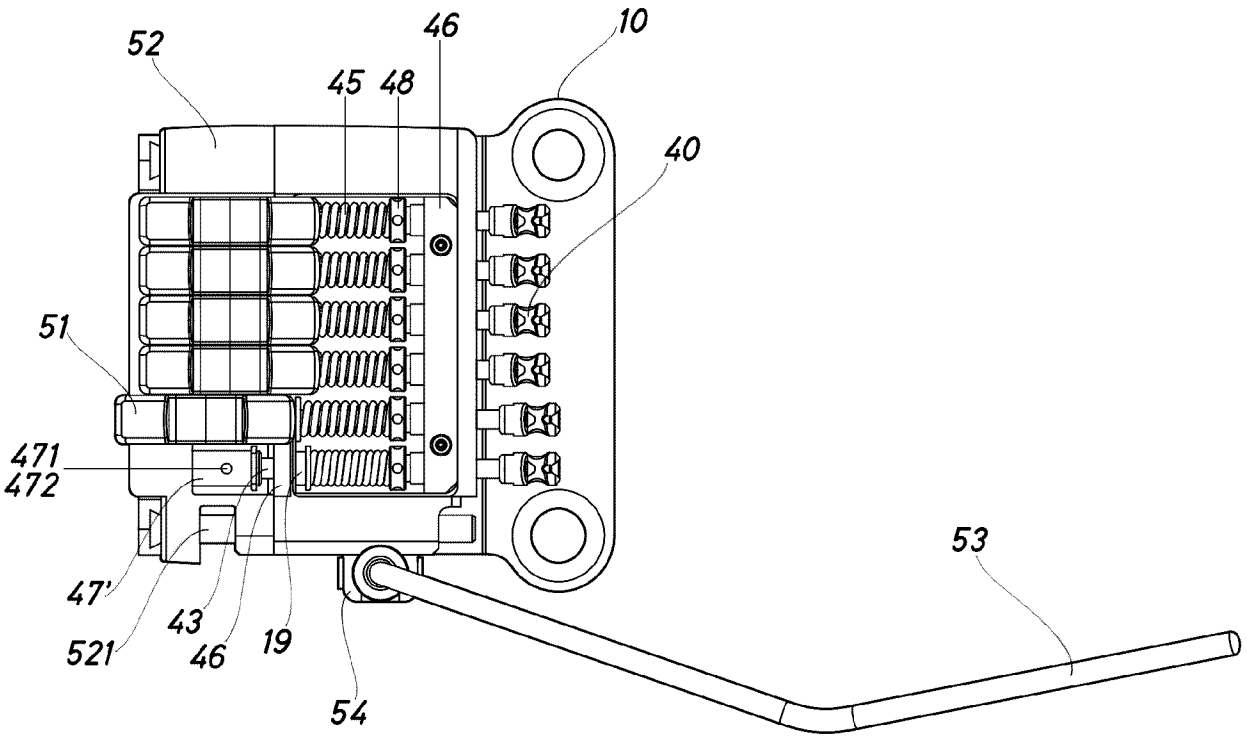
FIG. 20 corresponds to FIG. 19, with the tremolo actuation arm actuated, without showing one of the string selection actuators in order to allow further mechanical elements to be seen.

In particular, as can be seen in FIGS. 18 to 20, the arm -53- is located laterally with respect to the device, actuating, by means of a cam system -54-, a slide carriage -52-, which moves by sliding along the lateral guides -521-, -522-. This arrangement allows the slide carriage -52- to be arranged beneath the push-buttons -51- that allow the user to individually select which strings will be subjected to the action produced by the actuation of the arm -53-. The selection and deselection of which strings will be acted upon by the tremolo or vibrato is carried out by sliding the push-buttons -51-, which activate/deactivate the clutch system, which is described with reference to FIGS. 21 to 24.

As can be seen in said figures, in this embodiment the actuating end or actuating member -47'- takes the form of a sleeve that surrounds the rod -43-. The rod is connected to the runner -40- that receives the string (not illustrated), having in an intermediate position the system of springs -45- and stops -46-, -46'-, which is similar to that of the previous embodiments and therefore will not be described in detail. The actuating member -47'- has a series of holes -471- arranged peripherally with respect to a transverse cross-section. A ball -472- is housed in said holes -471-. In the figures, for reasons of clarity, two balls -472- are illustrated, one in an upper position and the other in a lower position, but it should be understood that there may be a single or several balls surrounding the rod -43-, preferably uniformly distributed and more advantageously being three or more balls.

The rod -43- also has an indentation or recess -431- to receive the ball -471-. Preferably, the recess -431- will be an indentation that covers the entire perimeter of the rod, but a specific recess could be created for each ball -472-.

The ball -472-, the hole or holes -471-, the housing or housings -512- and the recess or recesses -431- are dimensioned so that each ball can be completely housed either between a hole -471- and a recess -512- or between a hole -471- and a housing -512- and so that, in addition, the ball is capable of moving from one position to the other under the pushing forces produced by the different actuations of the system, such as the actuation of the arm that in turn moves the slide carriage -52-, or the actuation of the push-button -51-. When the ball or balls -472- that surround a rod -43- are completely housed between the recess -431- of the rod and the hole -471- of the actuating member -47'-, said balls -472- transmit the movement of the actuating member -47'- to the rod -43-. On the other hand, when the ball or balls -472- are completely housed between the housing -512- and said hole or holes -471-, there is no transmission of movement between the actuating member -47'- and the rod -43-.

Figure 21:
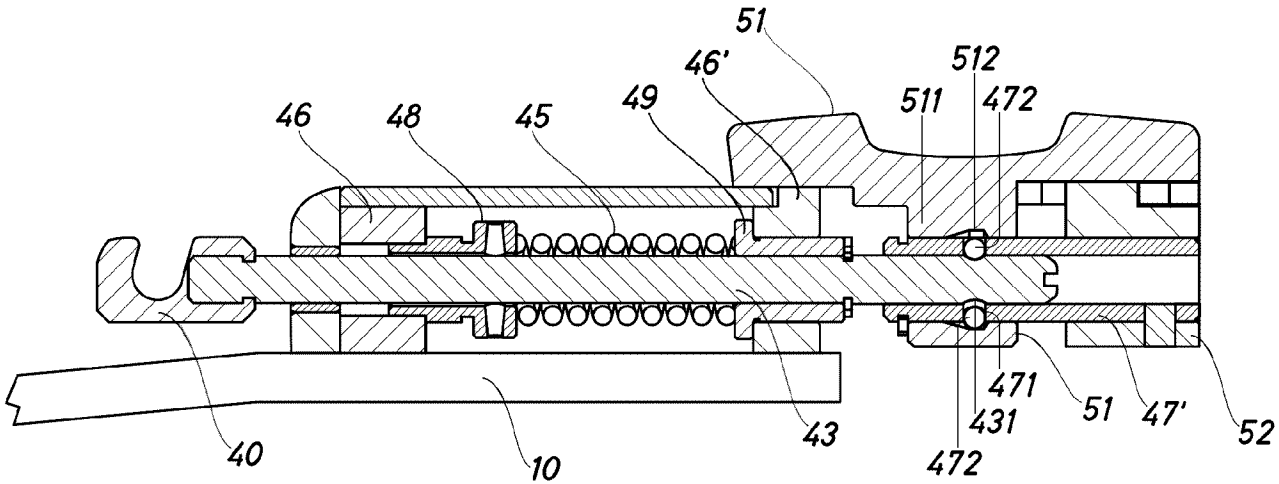
FIG. 21 is a longitudinal sectional view of a string actuation device, with the actuator in the active position (string selection) and the tremolo actuation arm not actuated.

FIG. 21 shows the system in the declutched position and without any actuation of the tremolo. The push-button -51- has an appendage -511- with a hole that surrounds the actuating member -47'-. The push-button or actuator -51- can slide relative to the actuating member -47'- in order to move from a clutched position to a declutched position. In FIG. 21, the appendage -511- of the push-button -51- has a housing -512- that coincides in position with the holes -471- of the actuating member -47'- and also with the recess -431- of the rod -43-. In the hole shown in the figure, the ball -472- located on top of the rod, due to the action of gravity, is completely housed in the hole -471- of the actuating member -47- and the recess -431- of the rod -43-. It should be noted that the action of gravity may arrange the lower ball -472- in the housing -512-.

Furthermore, as can be seen in the figure, the actuating member -47'- is joined integrally to the slide carriage -52-, which in turn is actuated by the arm (not shown in FIG. 21).

Figure 22:
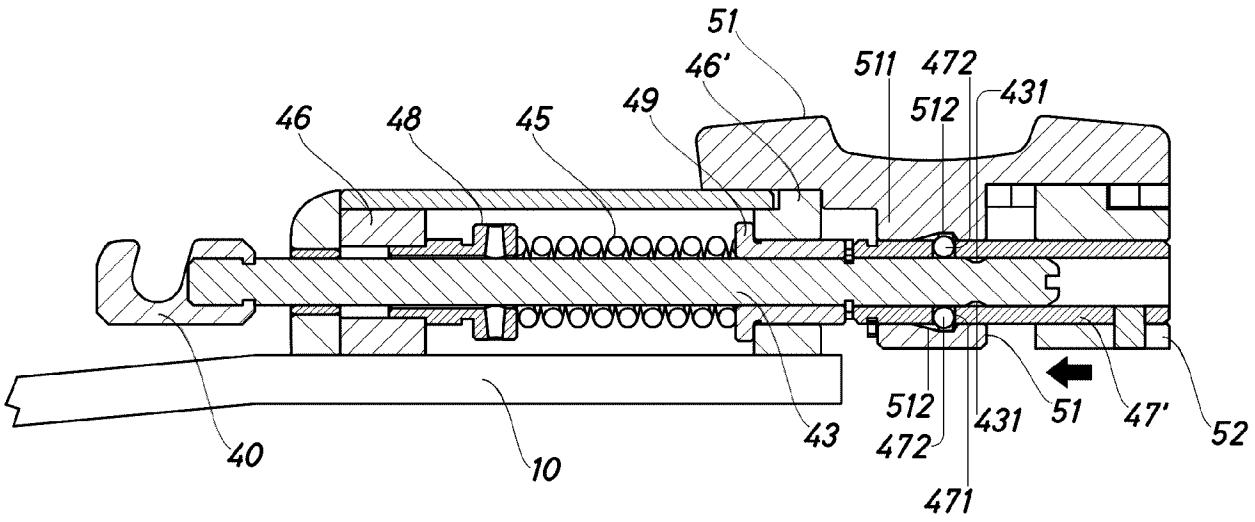
FIG. 22 is a longitudinal sectional view of a string actuation device, with the actuator in the active position (string selection) and the tremolo actuation arm actuated.

Thus, when the arm is actuated, the slide carriage -52- moves, causing the movement seen in FIG. 22.

As can be seen in FIG. 22, the actuating member -47'- moves with the slide carriage -52-. In turn, the movement of the actuating member pushes the ball or balls -472-. Upon being pushed, and due to the resistance to movement presented by the rod -43-, the balls -472- roll until they are completely housed between the housing -512- and the corresponding hole -472-, rolling on top of the rod. The slide carriage, -52-, actuating member -47- and push-button -51- move together as a unit, but the rod -43- remains in its place and does not transmit the movement to the runner -40-.

Figure 23:
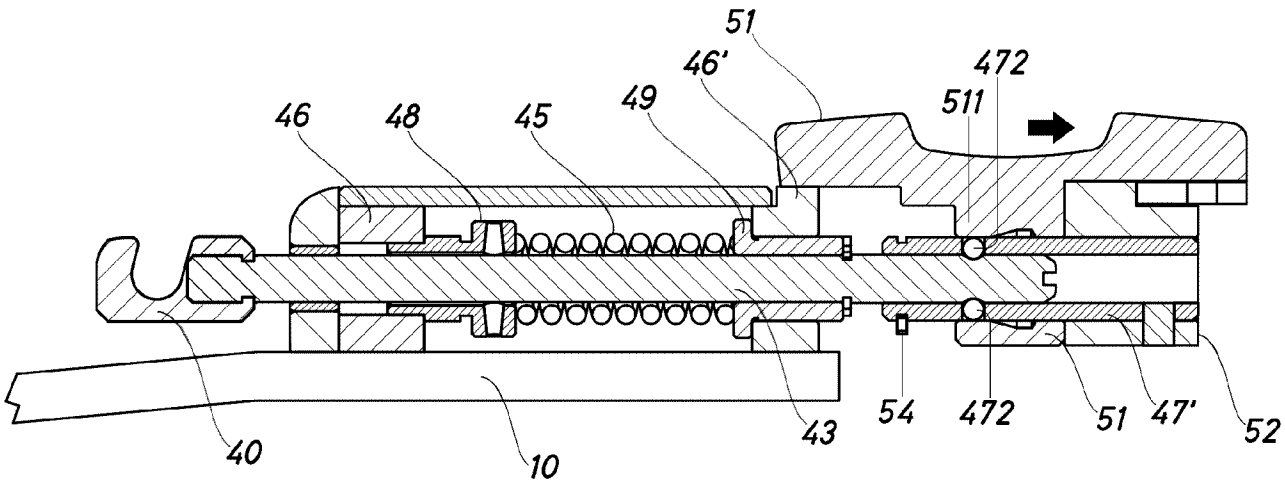
FIG. 23 is a longitudinal sectional view of a string actuation device, with the actuator in the passive position (no string selection) and the tremolo actuation arm not actuated.
Figure 24:
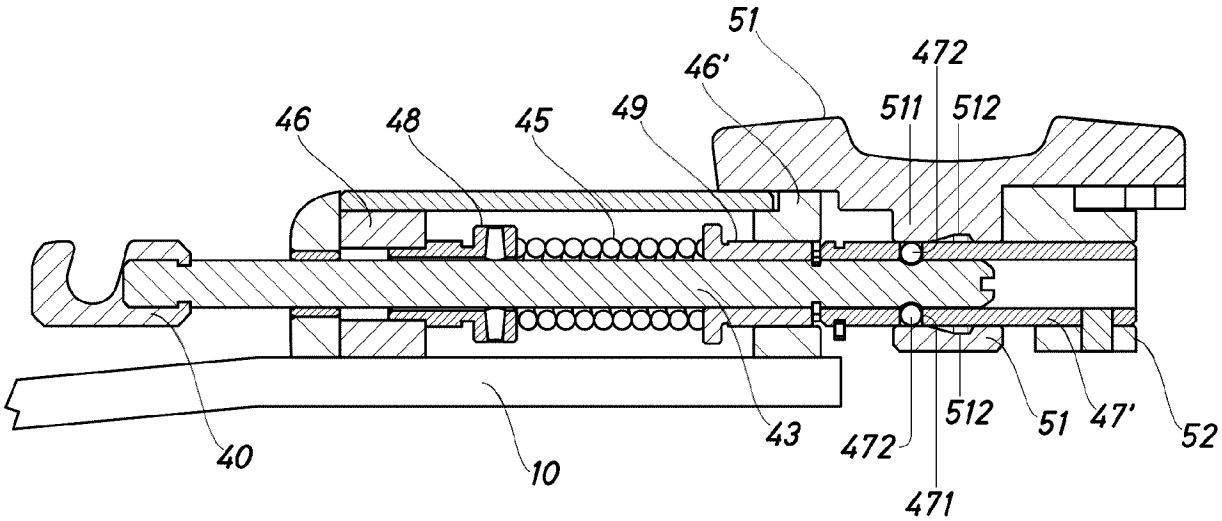
FIG. 24 is a longitudinal sectional view of a string actuation device, with the actuator in the passive position (no string selection) and the tremolo actuation arm actuated. It can be seen that the action of the arm is not transferred to the string runner.

If, on the other hand, before actuating the arm, the push-button -51- is actuated by sliding, the situation shown in FIG. 23 is produced. In this position, all the balls -472- are housed completely between their corresponding hole -471- of the actuating member -47'- and their corresponding recess -431- of the rod -43-. The housing -511- of the push-button or actuator -51- does not coincide with the hole -471-, offering a wall that covers the hole -471- and prevents the ball or balls -472- from escaping. In this situation, if the arm is actuated, the slide carriage -52- moves and the ball or balls -472-, being incapable of escaping from the place where they are housed, transmit the movement to the rod -43-, which consequently moves as a unit with the slide carriage and transmits the movement to the runner -40-, which in turn transmits it to the string.

The recovery of the spring -45-, which is compressed by the action of the rod -43-, returns the system to its initial position when the tremolo ceases to be actuated.

In addition, as can be seen, in this embodiment the runner -40- has no ball bearings and is situated in the air.

In this embodiment, the spring is located between two stops, in such a way that it always works under compression, i.e. the greatest working length that the device allows it is less than its natural length at rest. This ensures that the properties of the springs are not modified by deformations caused by extensions that result in spring lengths greater than their natural length at rest. This embodiment can be created regardless of whether or not a system exists for selecting which string or strings will be actuated by the tremolo.

Changes to the particular embodiments shown are possible without departing from the spirit of the invention. Thus, for example, although in the examples shown the tremolo can be actuated selectively on each individual string, embodiments are possible in which the tremolo acts simultaneously on different predetermined groups of strings. Embodiments are also possible without the system of springs shown, or with the system of springs but without the ability to select the string, strings or groups of strings to be acted upon by the tremolo. It is also possible, for example, to create combinations of the two embodiments shown.

Although the invention has been described with respect to preferred embodiments, said embodiments must not be regarded as limitative of the invention, which will be defined by the broadest interpretation of the following claims.

What is claimed is:

1. A device for altering the tension of the strings of a stringed musical instrument comprising:

a structural element, with at least one element for securing to the body of the instrument, said structural element comprising:

i. at least two runners capable of moving on said structural element, each of said runners being secured to at least one string of the musical instrument;

ii. an actuation mechanism for actuating the runners in order to alter the tension of the strings of the instrument, comprising at least one slide carriage adapted to be moved by the action of at least one lever, wherein said actuation mechanism further comprises a runner selection mechanism that comprises, in turn, a clutch for each of said runners for selective connection between the actuation mechanism and said runners.

2. The device according to claim 1, wherein each runner has at least one spring that acts with a tension opposite to the tension action of the strings on each runner.

3. The device according to claim 2, wherein said springs are located between a first stop, secured on said structural element, and a runner actuating member.

4. The device according to claim 3, wherein there is a second stop, secured on said structural element, which limits the possibility of extension of the spring.

5. The device according to claim 4, wherein the maximum length of the springs permitted by the device between said stops is less than the natural length of said springs at rest.

6. The device according to claim 3, wherein each runner is secured to a longitudinal rod, which in turn is connected to said runner actuating member.

7. The device according to claim 6, wherein each longitudinal rod moves through the inside of each spring arranged between the first stop and said runner actuating member.

8. The device according to claim 3, characterised in that each runner is connected directly to said runner actuating member.

9. The device according to claim 7, characterised in that each runner moves along the outside of each spring, arranged between the first stop and said actuating member, by means of a system of ball bearings.

10. The device according to claim 3, characterised in that said runner selection mechanism engages with said runner actuating member so as to allow said runner selection mechanism to act on said actuating member.

11. The device according to claim 6, wherein the runner actuating member is a sleeve that surrounds the rod, the rod has at least one recess, the actuating member has at least one hole, and the selection mechanism surrounds the actuating member and has at least one housing, said rod, actuating member and selection mechanism having the ability to slide relative to one another, so that they present a position in which the recess, hole and housing coincide, there being a ball having the ability to be fully housed, alternatively between the recess and the hole or between the hole and the housing, in such a way that the ball is housed between the recess and the hole and the recess and the selection mechanism are located in such a way that the housing does not coincide with the hole, the ball serving as a transmitter of movements between the actuating member and the rod.

12. The device according to claim 1, wherein said runner actuation mechanism comprises a slide carriage and two lateral guides for guiding the movements of said slide carriage, and an arm or lever and a cam for moving said slide carriage by pushing, by the actuation of an arm or lever, in both directions, along the path provided by said lateral guides.

13. The device according to claim 1, wherein each runner slides by means of a system of ball bearings.

* * * * *